US012800278B2

(12) United States Patent
Sadler et al.

(10) Patent No.: US 12,800,278 B2
(45) Date of Patent: Nov. 17, 2026

(54) MULTI-POINT INITIATION SYSTEM FOR A RADIAL MULTIPLE SHAPED CHARGE JET (MSCJ) WARHEAD

(71) Applicant: Raytheon Company, Arlington, VA (US)

(72) Inventors: Coulton T. Sadler, Tucson, AZ (US); Brian J. Lukow, Tucson, AZ (US); Christopher M. Turner, Oro Valley, AZ (US); John R. Leach, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 40 days.

(21) Appl. No.: 18/970,651

(22) Filed: Dec. 5, 2024

(65) Prior Publication Data

US 2026/0168774 A1 Jun. 18, 2026

(51) Int. Cl.

| | |
|---|---|
| ***F42B 12/10*** | (2006.01) |
| ***F42B 12/20*** | (2006.01) |
| ***F42B 12/22*** | (2006.01) |
| ***F42B 12/24*** | (2006.01) |

(52) U.S. Cl.

CPC ..... *F42B 12/10* (2013.01); *F42B 12/207* (2013.01); *F42B 12/22* (2013.01); *F42B 12/24* (2013.01)

(58) Field of Classification Search

CPC .. F42B 3/08; F42B 12/02; F42B 12/10; F42B 12/105; F42B 12/14; F42B 12/16; F42B 12/207; F42B 12/22; F42B 12/24

USPC ..... 102/306–310, 476

See application file for complete search history.

(56) References Cited

U.S. PATENT DOCUMENTS 2,725,821 A 12/1955 Coleman
3,145,656 A * 8/1964 Cook ..... F42B 12/14 102/307
3,490,372 A 1/1970 Lavine
(Continued)

FOREIGN PATENT DOCUMENTS

CN 105389415 B 8/2018
CN 107024149 B 8/2018
(Continued)

OTHER PUBLICATIONS

Machine translation of JP-2021071245-A (Year: 2021).*
(Continued)

*Primary Examiner* — James S Bergin
(74) *Attorney, Agent, or Firm* — Schwegman Lundberg & Woessner, P.A.

(57) ABSTRACT

A radial multiple shaped charge jet (MSCJ) warhead is detonated to cut a liner and to form and propel radially a plurality of SCJs. A liner is placed on an outer surface of an annular cylindrical column of explosive. A plurality of booster charges are spaced apart on an inner surface of the column of explosive and, if recessed, aligned to centers of the recesses. An initiation system provides for multi-point initiation of the plurality of booster charges to detonate the column of explosive to produce a plurality of detonation waves that constructively interfere at multiple locations at mid-points between the boosters on the back surface of the liner to cut the liner and to form and propel radially outward a plurality of SCJs with minimal or no axial velocity component.

18 Claims, 9 Drawing Sheets

(56) References Cited

U.S. PATENT DOCUMENTS 3,763,784 A * 10/1973 Mallory ..... F42B 12/10 102/476
3,902,422 A 9/1975 Coursen
3,978,796 A * 9/1976 Hackman ..... F42B 12/14 102/495
3,998,162 A * 12/1976 Forrest ..... F42B 12/14 102/701
4,018,163 A 4/1977 Brown
4,175,491 A * 11/1979 Thomanek ..... F42B 10/14 244/3.25
4,374,495 A * 2/1983 Thomanek ..... F42B 12/14 102/306
4,406,226 A 9/1983 Davitt et al.
4,649,828 A 3/1987 Henderson et al.
4,711,181 A * 12/1987 Ringel ..... F42B 1/02 102/476
4,770,097 A 9/1988 Wilson et al.
4,892,039 A 1/1990 Emerson et al.
4,896,609 A 1/1990 Betts et al.
4,915,029 A 4/1990 Appledorn et al.
4,960,171 A 10/1990 Parrott et al.
4,974,515 A * 12/1990 Busch ..... F42B 12/14 102/501
5,038,683 A 8/1991 Baker et al.
5,070,786 A * 12/1991 Hartman ..... F42B 12/10 102/214
5,359,935 A 11/1994 Willett
5,479,860 A 1/1996 Ellis
5,531,164 A 7/1996 Mosley
5,540,156 A 7/1996 Fong
5,700,969 A 12/1997 Mosley
5,714,712 A 2/1998 Ewick et al.
6,220,167 B1 4/2001 Yamamoto et al.
6,393,991 B1 5/2002 Funston et al.
6,457,416 B1 10/2002 Micke et al.
6,606,951 B1 8/2003 Klein
6,772,105 B1 8/2004 Heck, Sr.
7,047,886 B2 5/2006 Micke et al.
7,418,373 B2 8/2008 Heck, Sr.
8,127,686 B2 3/2012 Lloyd
8,380,436 B2 2/2013 Heck, Sr.
8,393,393 B2 3/2013 Rodgers et al.
8,397,800 B2 3/2013 Rodgers et al.
8,397,814 B2 3/2013 Rodgers et al.
8,408,286 B2 4/2013 Rodgers et al.
8,418,623 B2 4/2013 Lloyd
8,434,411 B2 * 5/2013 Daoud ..... F42B 12/10 102/482
8,490,686 B2 7/2013 Rodgers et al.
8,538,698 B2 9/2013 Heck, Sr.
8,714,251 B2 5/2014 Glenn et al.
8,714,252 B2 5/2014 Glenn et al.
8,770,110 B2 * 7/2014 Ames ..... F42B 12/208 102/478
8,875,796 B2 11/2014 Hales et al.
8,881,816 B2 11/2014 Glenn et al.
8,899,320 B2 12/2014 Le
8,978,749 B2 3/2015 Rodgers et al.
8,978,817 B2 3/2015 Rodgers et al.
8,985,200 B2 3/2015 Rodgers et al.
9,091,152 B2 7/2015 Rodgers et al.
9,206,675 B2 12/2015 Hales et al.
9,291,437 B2 * 3/2016 Bonnstetter ..... F42B 12/26
9,297,228 B2 3/2016 Martinez et al.
9,310,172 B2 * 4/2016 Zussman ..... F42B 12/24
9,383,176 B2 7/2016 Arguello et al.
9,447,678 B2 9/2016 Walter et al.
9,598,940 B2 3/2017 Rodgers et al.
9,909,408 B2 3/2018 Rodgers et al.
9,926,777 B2 3/2018 Rodgers et al.
9,995,562 B2 6/2018 Jennett et al.
11,486,233 B2 11/2022 Sadler et al.
12,535,304 B2 * 1/2026 Sadler ..... F42B 1/028
12,566,052 B2 * 3/2026 Sadler ..... F42B 12/10
2013/0239837 A1 * 9/2013 Ames ..... F42B 12/22 102/478
2014/0230682 A1 * 8/2014 Bonnstetter ..... F42B 12/26 86/53
2024/0210147 A1 * 6/2024 Cohen ..... F42B 12/208

FOREIGN PATENT DOCUMENTS

CN 111964545 A 11/2020
EP 3167147 B1 1/2020
JP 2021071245 A * 5/2021

OTHER PUBLICATIONS

Fong, Richard, et al., "Multiple Explosively Formed Penetrator (MEFP) Warhead Technology Development", (Dec. 2004), 3 pgs.
Liu, Jie, et al., "A study on the surface overpressure distribution and formation of a double curvature liner under a two-point initiation", Defence Technology, vol. 18, Issue 1, (Jan. 2022), 148-157.

* cited by examiner

INITIAL TIME

DETONATION WAVES MOVE THROUGH EXPLOSIVE COLUMN

DETONATION WAVES MOVE THROUGH EXPLOSIVE COLUMN

DETONATION WAVES CAUSE LINER RECESSES TO COLLAPSE

STRETCHING SCJ

SCJ FORMED - BEGIN TO STRETCH

CONTINUED SCJ FORMATION

INITIAL SCJ FORMATION

MULTI-POINT INITIATION SYSTEM FOR A RADIAL MULTIPLE SHAPED CHARGE JET (MSCJ) WARHEAD

BACKGROUND

Field

This disclosure relates to radial multiple shaped charge jet (MSCJ) warheads, and more particularly to a manner of initiation to optimize the velocity vector of the individual shaped-charge jets for maximum penetration.

Description of the Related Art

Shape-forming charges are explosive charges shaped to focus the effect of the explosive's energy in specific direction and are purely kinetic in nature. A shape-forming charge is composed of two major components: an explosive charge and a metal liner on a forward surface of the explosive charge. Shape-forming charges may be used to penetrate armor, punch holes in naval vessels such as surface ships or submarines or to perforate wells in the oil and gas industry.

One type of shape-forming charge is referred to as a shaped charge. In a unitary shaped charge, the shaped charge liner has an "apex angle" of 60° or less about an axis of the warhead (e.g., a conical shaped liner along the axis of the warhead). Upon detonation, the liner material collapses toward the centerline and is projected forward as both a slug and a metal jet. The slug makes up approximately 75% of the liner mass and has minimal penetration. The metal jet tip travels much faster than the slug (at least 2×) and thus has much greater penetration capabilities than the slug.

A central detonator, array of detonators or detonation waveguide shape the detonation wave(s) into a plane wave that strikes the metal liner to form the slug and metal jet. The enormous pressure at the front of the plane wave generated by the detonation of the explosive drives the liner in the hollow cavity inward to collapse upon its central axis to project a high-velocity jet of metal particles forward along the axis.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides a radial multiple shaped charge jet (MSCJ) warhead in an annular cylindrical column of explosive is detonated in such a manner to provide elevated pressure at multiple locations on the inner surface of the liner to cut the liner and to form and propel radially a plurality of SCJs radially outward with minimal to no axial velocity component.

In an embodiment, a warhead includes a liner on an outer surface of an annular cylindrical column of explosive and a plurality of booster charges spaced apart in a uniform spacing on an inner surface of the column of explosive. An initiation system is configured for multi-point initiation of the plurality of booster charges to detonate the column of explosive to produce a plurality of detonation waves that constructively interfere at the multiple locations on the inner surface of the liner to cut the liner and to form and propel radially a plurality of SCJs with minimal to no axial velocity component. In different embodiments, the waves constructively interfere to produce elevated pressures are between 110% and 200% of the detonation pressure at the front of an individual detonation wave.

In an embodiment, at mid-points between boosters, pairs of directly adjacent detonation waves produce the elevated pressures at multiple locations in a non-planar wave within a defined distance range from the plurality of booster charges. The liner is positioned within that range. Short of that range adjacent detonation waves do not interfere sufficiently to form the elevated pressure location and beyond that range interference of the plurality of detonation waves forms a planar wave. Within this "range", $0.1<=T1/D1<=0.5$ where T1 is the thickness of the column of explosive and D1 is the diameter of the warhead In an embodiment, the liner is formed with a plurality of recesses. The plurality of booster charges are aligned to the centers of the recess such that each recess is cut and formed into a SCJ. The thickness of each recess may be contoured to form and shape the SCJ. For example, each recess may have uniform thickness or may be thinner in the center and thicker towards the edges to encourage formation of each SCJ. Recesses must have an apex angle less than 180° and may include shallow dimples typically having an apex angle of, for example, 120-170°, or deep drawn conical structures such as conical, trumpet, "norman helmet", etc. having an apex angle of 40-120°. Each SCJ may have a tip velocity of 4-10 km/s and a penetration depth of 7-10× the recess diameter. Suitably, $0.5<=T1/D2<=1.5$ where D2 is the recess diameter.

In an embodiment, the booster charges are arranged in a pattern (e.g., a honeycomb pattern) having X planes spaced along an axis of the column of explosive, each plane including Y booster charges spaced around the inner surface of the annular cylindrical column of explosive. The initiation system includes X boards positioned inside the annular cylindrical column of explosive and spaced in alignment with each of the X planes. Each board has a detonation point that is connected via Y equal length explosive tracks to one of the Y booster charges positioned around the inner surface of the annular cylindrical column of explosive. In most applications, all of the detonation points detonate simultaneously to detonate all of the boosters simultaneously and form and radially propel all of the SCJs simultaneously. However, the detonation of the SCJs in the different planes could be staggered or the lengths of the explosive tracks on a given board could be staggered to facilitate a patterned initiation of the plurality of booster charges and the multiple SCJs.

To form all of the SCJs simultaneously, each of the X detonation points can be provided with a detonator that responds to an electrical stimulus to initiate the Y explosive tracks. This requires X detonators and separate electrical wiring for each detonator. Alternately, a single detonator can be positioned on (or near) the $1^{st}$ board at an initial initiation point. Explosive material in the form of a "jumper" connects the initial initiation point from the $1^{st}$ board to the $2^{nd}$ board and so forth to the final Xth board. As the detonation propagates from one board to the next there is a measurable time delay. Each board includes an explosive delay track that connects the initiation point to the detonation point. The length of explosive delay track, hence the associated time delay, is the longest on the $1^{st}$ board and progressively shorter until the final Xth board. These delays are designed to compensate for the measurable time delay as the detonation propagates from one board to the next such that all of the detonation points fire simultaneously. The explosive delay tracks may be formed on an opposite side of the board or a paired board.

In an embodiment, cabling is run from forward of the warhead through the center of the initiation system to aft of the warhead.

These and other features and advantages of the disclosure will be apparent to those skilled in the art from the following detailed description of preferred embodiments, taken together with the accompanying drawings, in which:

DETAILED DESCRIPTION

Figure 1A:
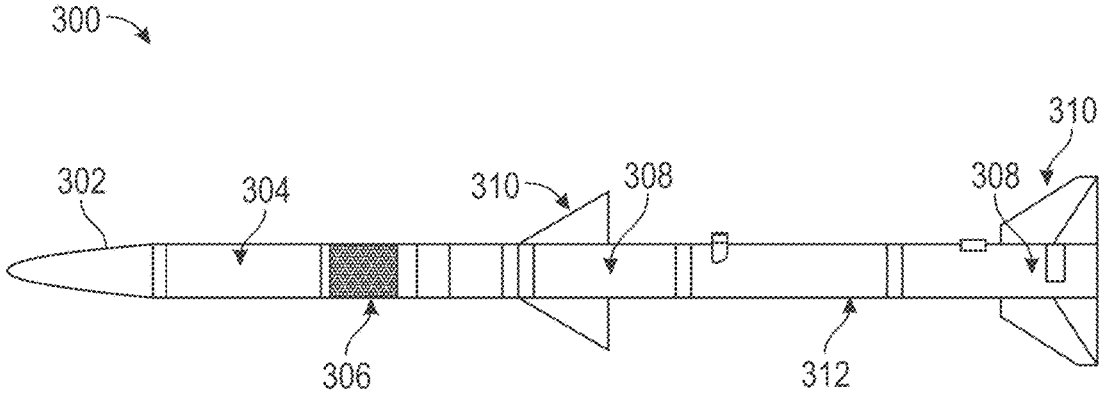
FIGS. 1A-1B are the perspective view of a missile including a multi-point initiated radial MSCJ warhead and is a partial cut-away view of the multi-point initiated radial MSCJ.
Figure 1B:
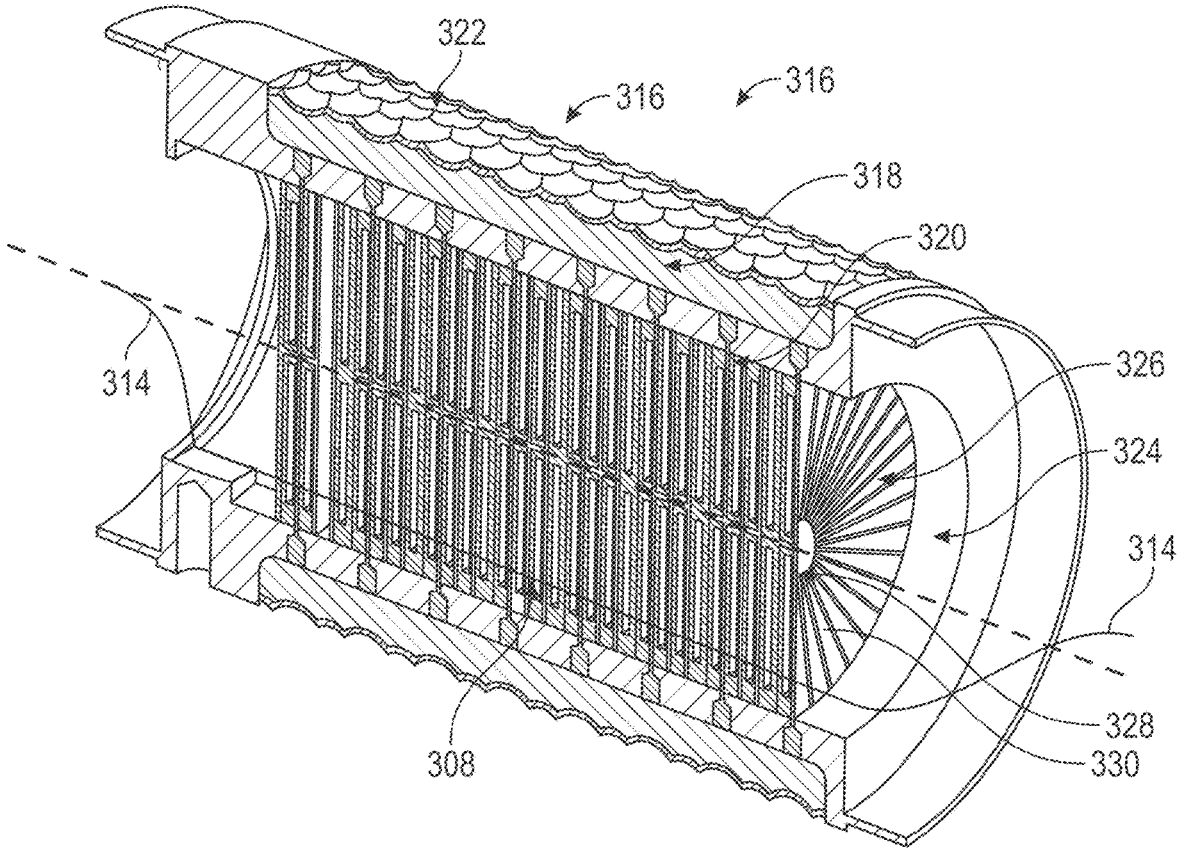
Figure 2B:
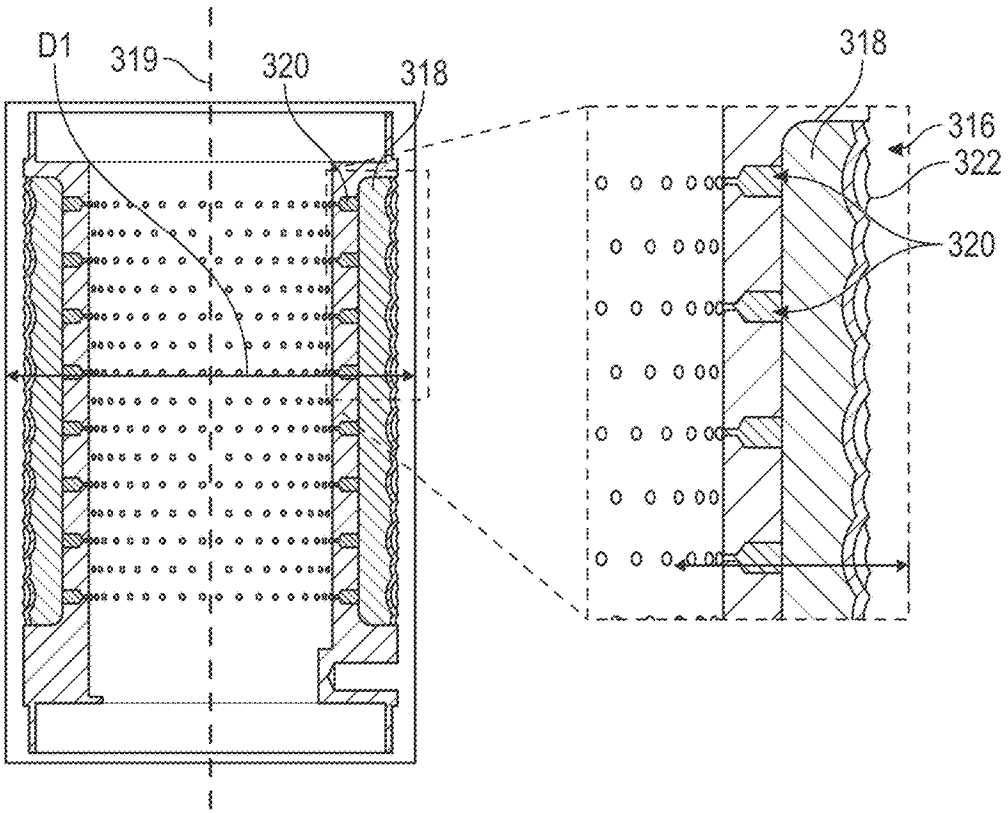
FIGS. 2A-2B are sections view of the multi-point initiated radial MSCJ.
Figure 2A:
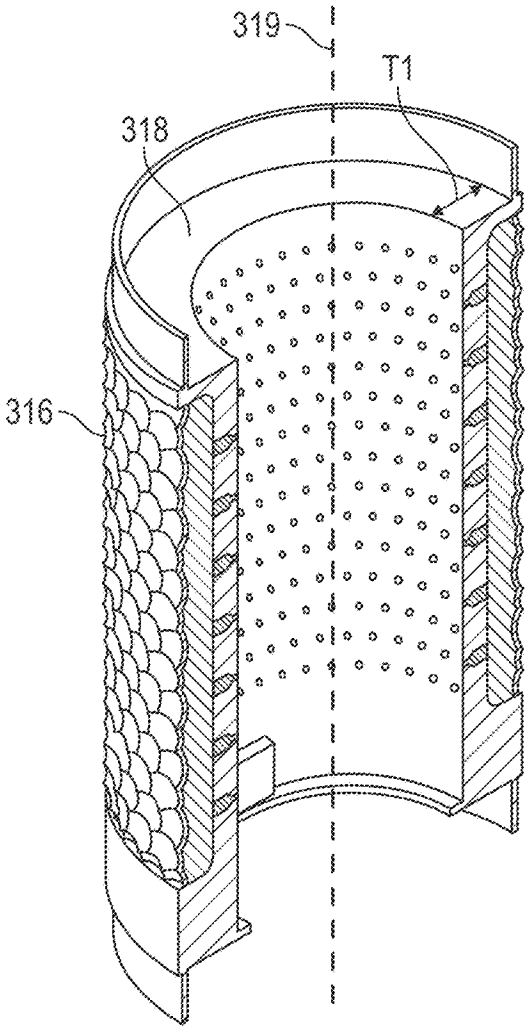

The present disclosure provides a radial multiple shaped charge jet (MSCJ) warhead in which an annular cylindrical column of explosive is detonated to provide elevated pressure at multiple locations on the back surface of the liner to cut the liner and to form and propel forward a plurality of SCJs radially outward with minimal to no axial velocity component.

Referring now to FIGS. 1A-1B and 2A-2B, in an embodiment a missile 300 includes a nose cone 302, guidance section 304, a radial MSCJ warhead 306, control sections 308 and wings 310, and a rocket motor 312. The design of radial MSCJ warhead 306 allows the pass through of cables 314 to pass power and signals from the guidance section 304 to the control section 308 and rocket motor 312. Cable pass through capability is critical given the alternative is to route the cables on the outside of the warhead, which will reduce warhead effectiveness and increase aerodynamic drag.

Radial MSCJ warhead 306 includes a cylindrical liner 316 on an outer surface of an annular cylindrical column of explosive 318. A plurality of booster charges 320 spaced apart on an inner surface of column of explosive 318. The booster charges may be arranged in a pattern having X planes spaced along an axis 319 of the column of explosive, each plane including Y booster charges spaced around the inner surface of the annular cylindrical column of explosive 318. In the example shown, the pattern includes X=16 planes and Y=38 boosters in a circle in each plane.

As shown cylindrical liner 316 includes and X×Y honeycomb pattern of recesses 322. A booster charge 320 is aligned to the center of each recess 322.

An initiation system 324 is configured for multi-point initiation of the plurality of booster charges 320 to detonate the annular cylindrical column of explosive 318 to produce a plurality of detonation waves that constructively interfere at multiple locations on the back surface of the liner to cut the liner at the edges of each recess 322 and to form and propel radially outward a plurality of SCJs with minimal or no axial velocity component. In different embodiments, the waves constructively interfere to produce elevated pressures are between 110% and 200% of the detonation pressure at the front of an individual detonation wave.

At mid-points between booster charges 320, pairs of directly adjacent detonation waves produce the elevated pressures at multiple locations in a non-planar wave within a defined distance range from the plurality of booster charges. The cylindrical liner 316 is positioned within that range. Short of that range adjacent detonation waves do not interfere sufficiently to form the elevated pressure location and beyond that range interference of the plurality of detonation waves forms a planar wave. Within this "range", $0.1<=T1/D1<=0.5$ where T1 is the thickness of the column of explosive and D1 is the diameter of the warhead and $0.5<=T1/D2<=1.5$. where D2 is the recess diameter.

Initiation system 324 includes X boards 326 positioned inside the annular cylindrical column of explosive 318 and spaced along the axis 319 of the column of explosive 318 in alignment with respectively planes of booster charges 318. Each board 326 includes a detonation point 328 that is connected via Y equal length explosive tracks 330 to one of the Y booster charges 318. Each of the detonation points 328 is detonated at the same time to produce detonation waves that travel through the explosive tracks 330 to simultaneously initiate all of the booster charges 318. As will be described below, all of the X boards 326 can be detonated from a single detonator or each of the X boards 326 can be provided with its own detonator. Either configuration can be designed to produce a simultaneous formation and radially ejection of multiple SCJs with minimal to no axial velocity component.

Cabling 314 passes through radial MSCJ warhead 306 through each of the boards 326 between the explosive tracks 330.

The detonation of the SCJs in the different planes could be staggered or the lengths of the explosive tracks on a given board could be staggered to facilitate a patterned initiation of the plurality of booster charges and the multiple SCJs.

Figure 3:
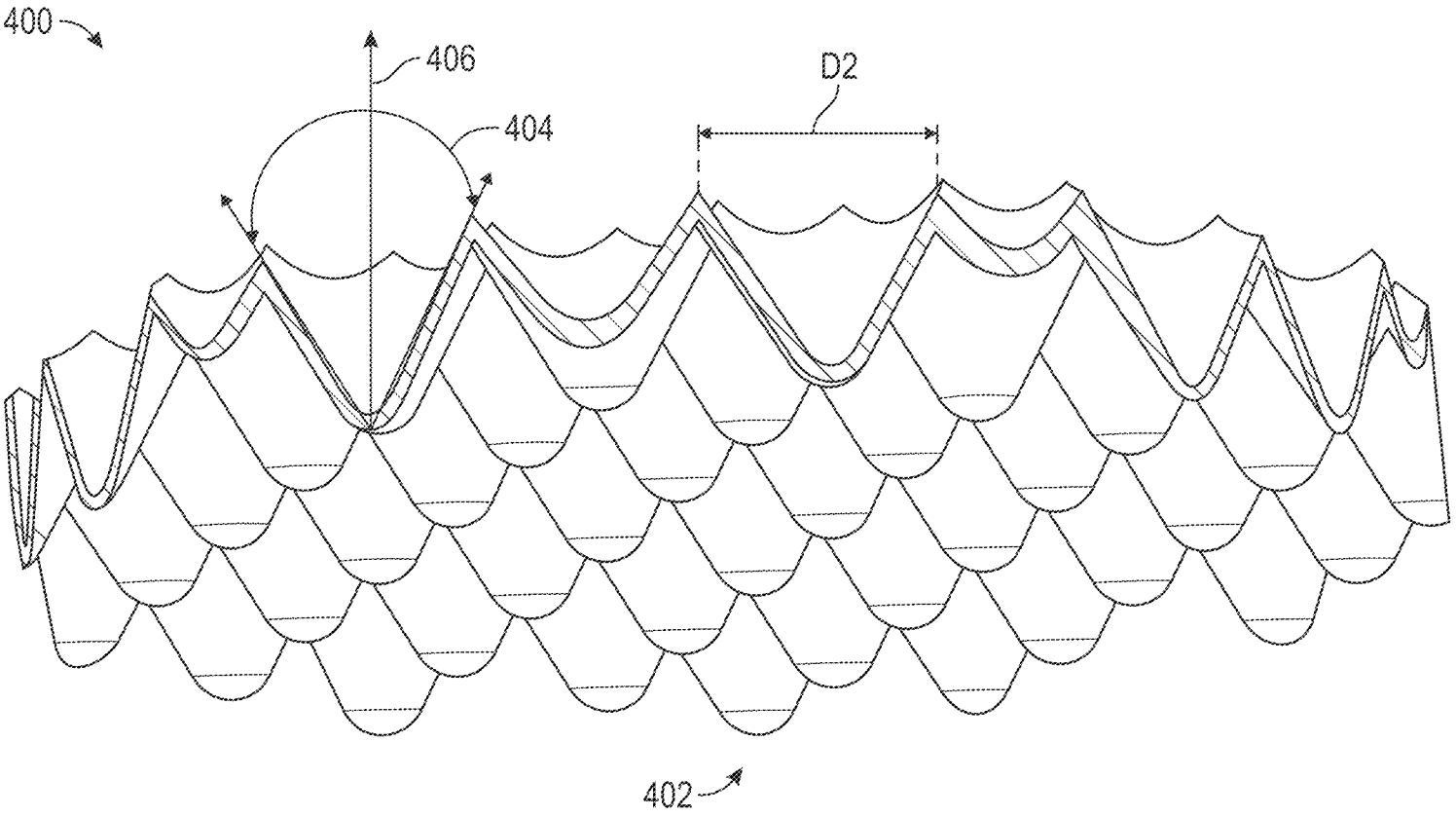
FIG. 3 is a view of a recess in the recessed liner.

Referring now to FIG. 3, in an embodiment, a recessed liner 400 includes a plurality of hexagonal recesses 402 (e.g., a depression or indentation in the surface of the liner) having the same size and shape in a regular honeycomb pattern. The thickness of each recess 402 may be contoured to form and shape the SCJ. For example, each recess may have uniform thickness or may be thinner in the center and thicker towards the edges to encourage formation of each SCJ. Recesses must have an apex angle 404 less than 180° about an axis 406 perpendicular to a long axis of the warhead and may include shallow dimples typically having an apex angle of, for example, 120-170°, or deep drawn conical structures such as conical, trumpet, "norman helmet", etc. having an apex angle of 40-120°. Each SCJ may have a tip velocity of 4-10 km/s and a penetration depth of 7-10× the recess diameter.

Figure 4A:
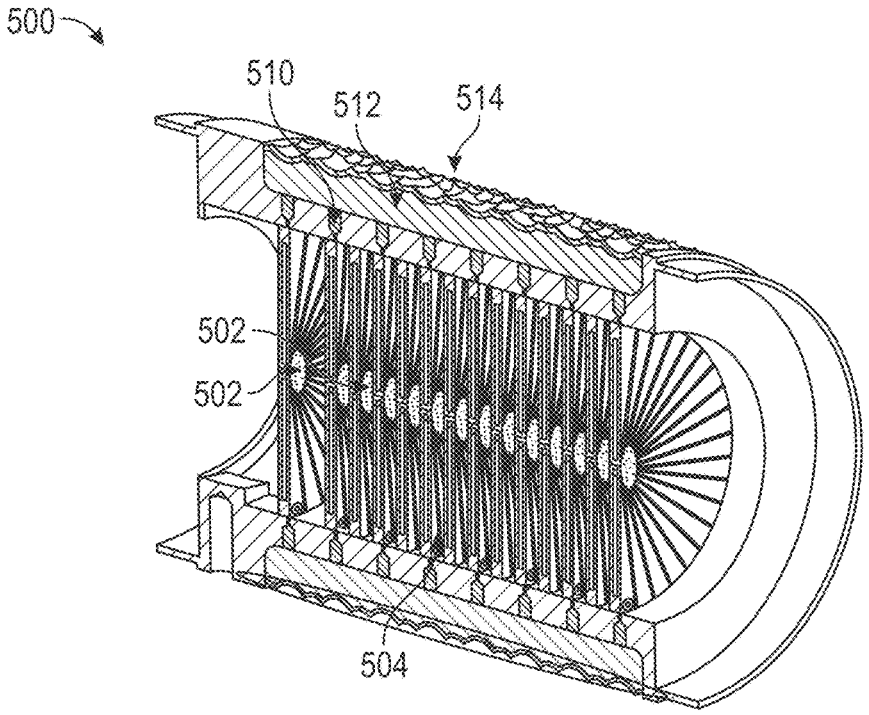
FIG. 4A-4B are a partial cut-away of a radial MSCJ warhead and one board of the multi-point initiation system in which each board is provided with its own detonator to synchronize formation of the SCJs.
Figure 4B:
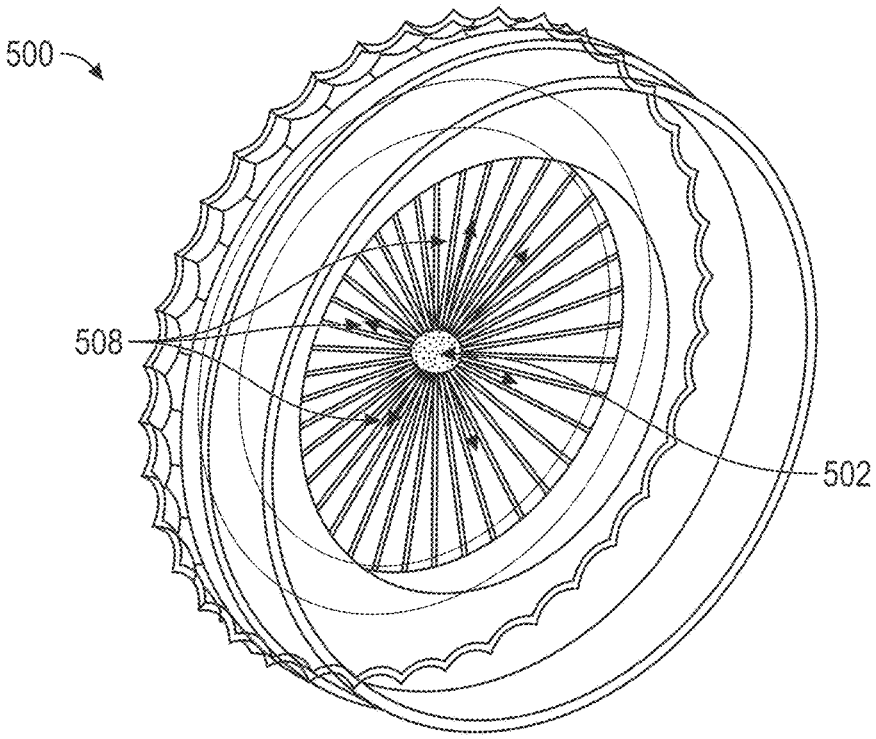
Figure 5A:
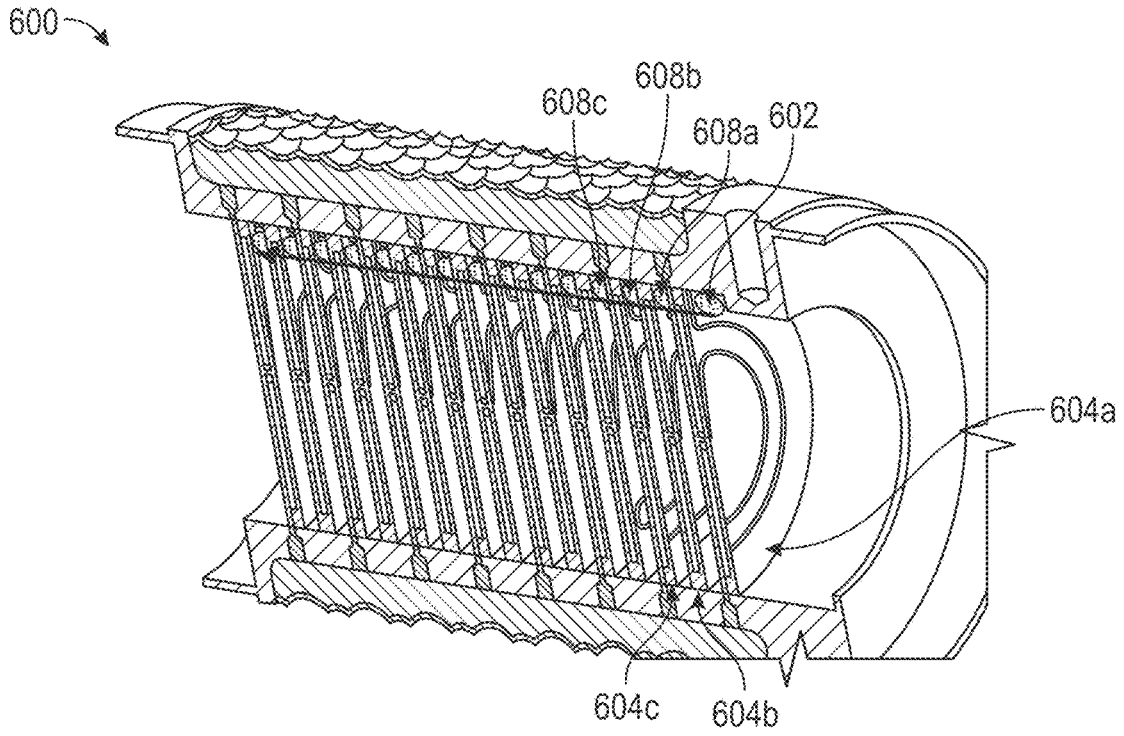
FIGS. 5A-5B and 6A-6C are a partial cut-away of a radial MSCJ warhead and one board of the multi-point initiation system in which a single detonator initiates all of the boards and each board is provided with a delay line to synchronize formation of the SCJs.
Figure 5B:
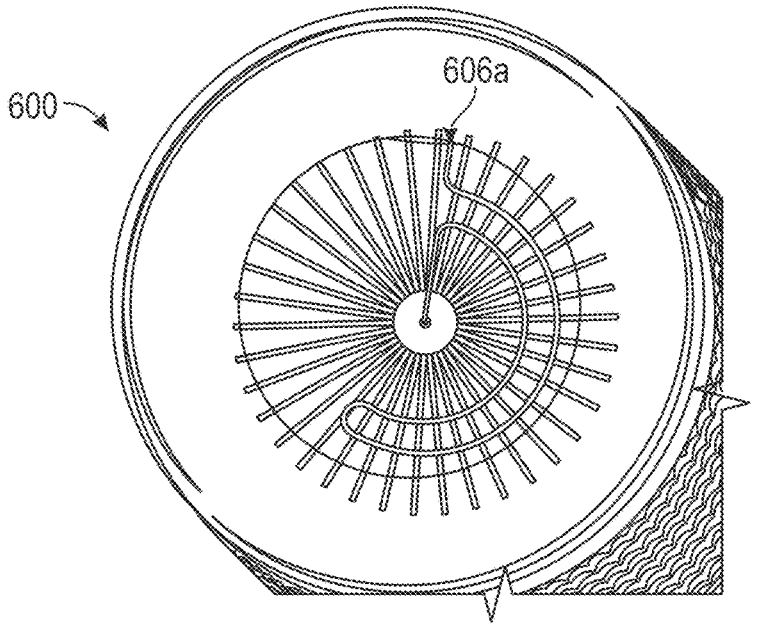
Figure 6A:
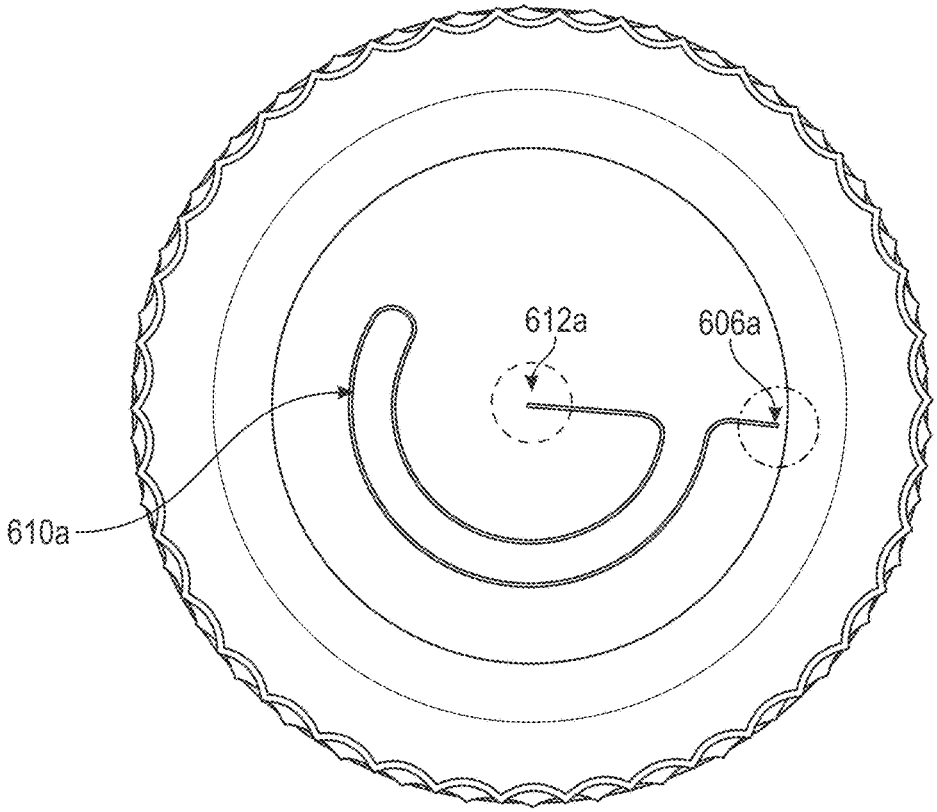
Figure 6B:
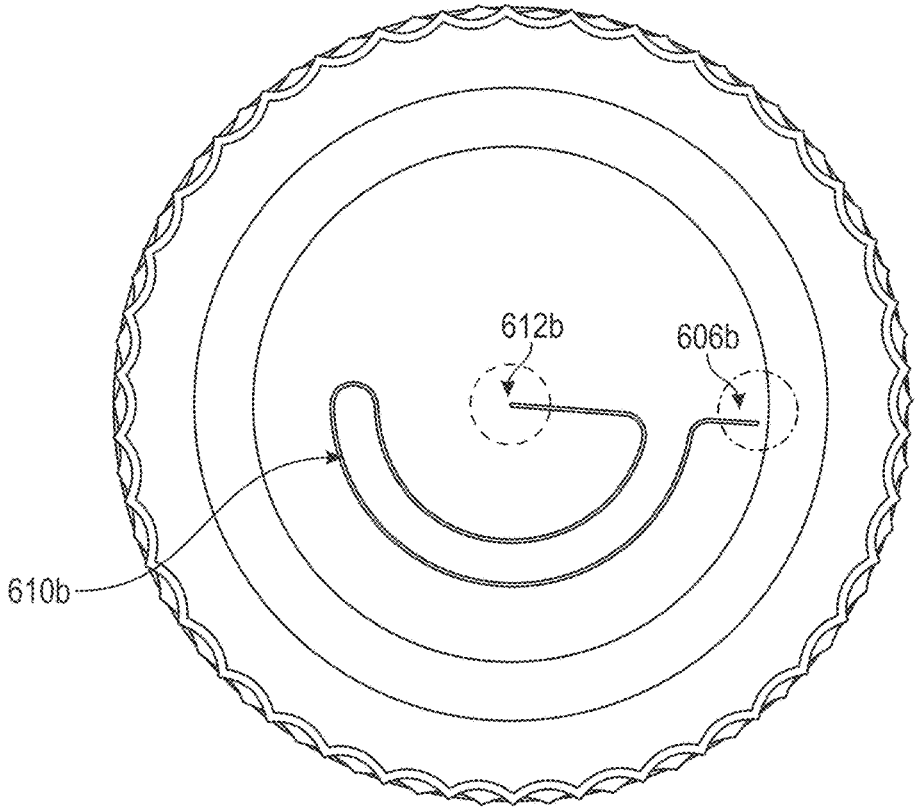
Figure 6C:
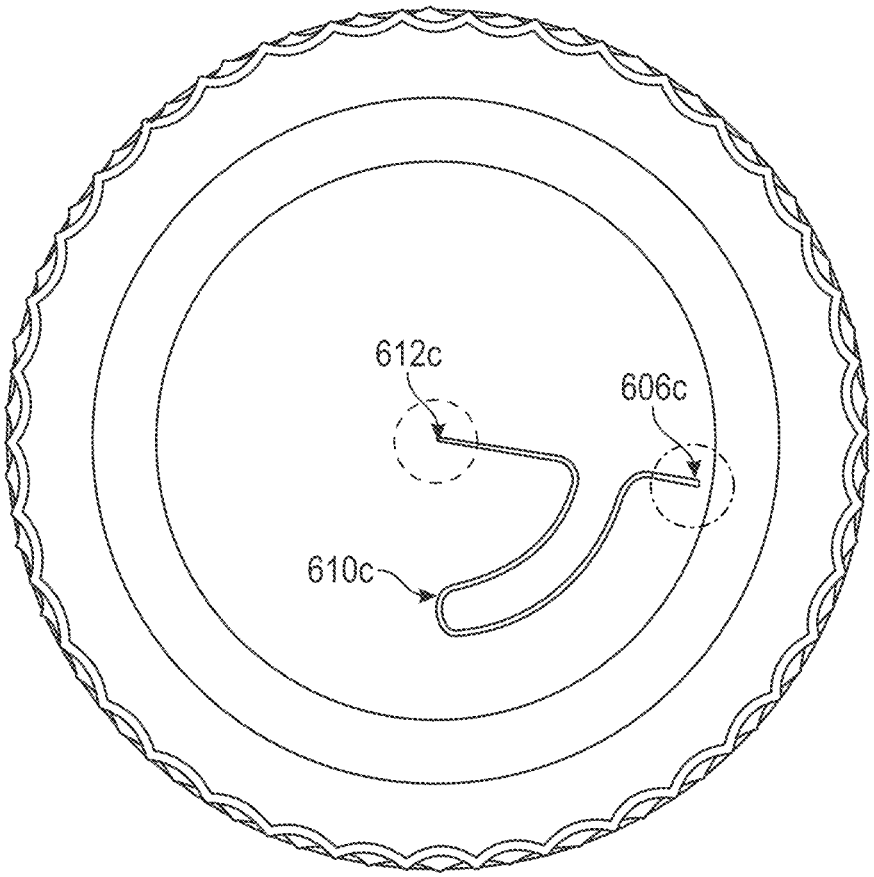
Figure 7A:
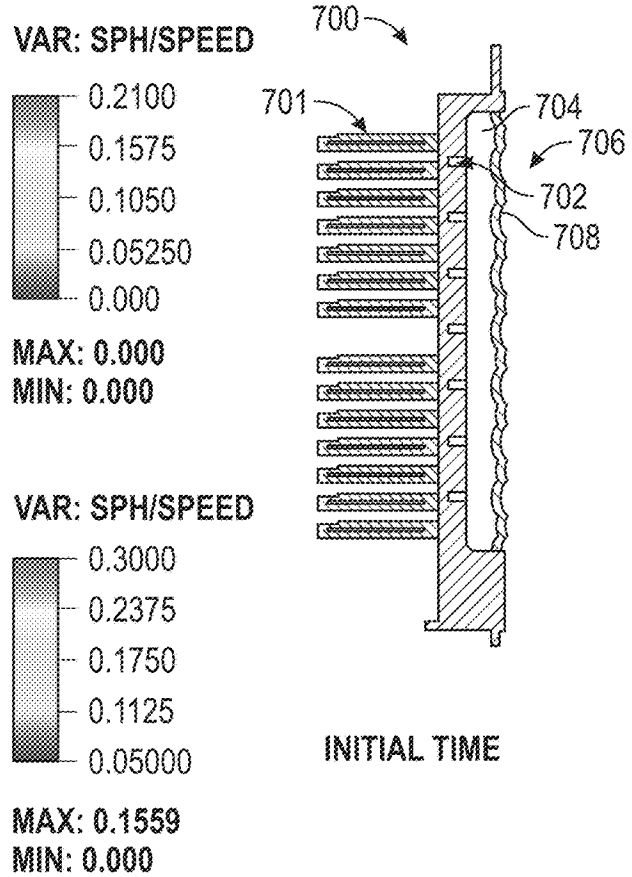
FIGS. 7A-7H are a time-series of plots illustrating a detonation sequence to form and propel multiple SCJs radially from the warhead with little to no axial velocity component.
Figure 7B:
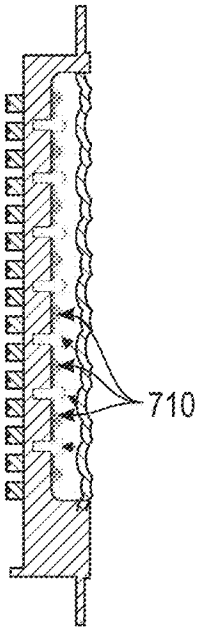
Figure 7C:
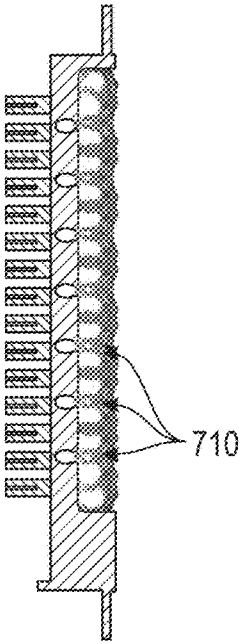
Figure 7D:
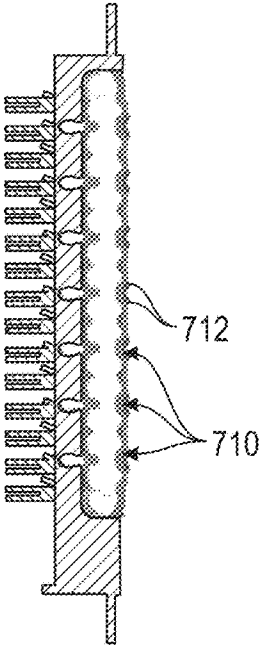
Figure 7H:
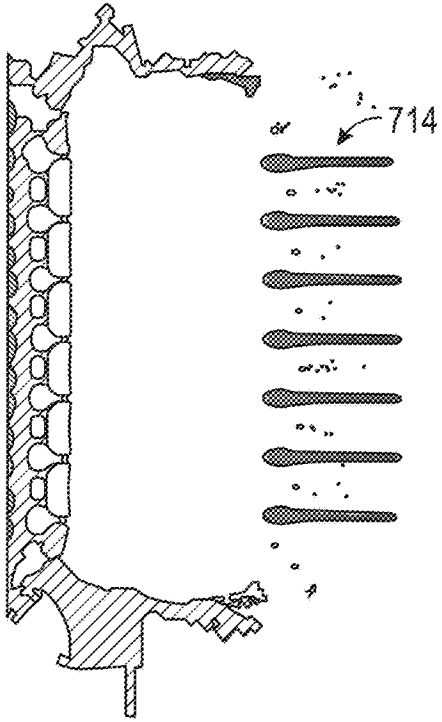
Figure 7G:
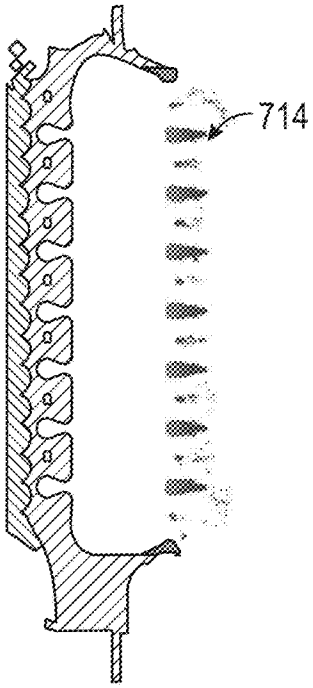
Figure 7F:
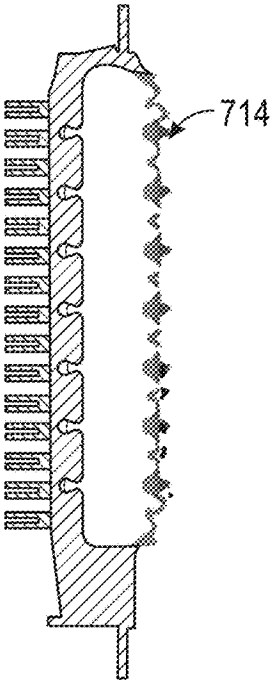
Figure 7E:
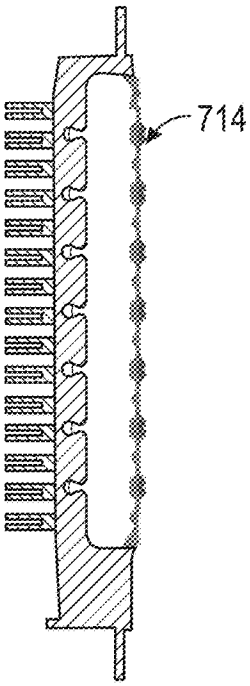

Referring now to FIGS. 4A-4B, an embodiment of a multi-point initiation system 500 uses one detonator 502 per board 504 at the board's detonation point (e.g, center of the board) for a total of X detonators. Each detonator 502 is provided with its own electrical stimulus via wires (not shown). Each detonator 502 produces a detonation wave that travel through equal length explosive tracks 508 to booster charges 510, which in turn detonate an annular cylindrical column of explosive 512 to produce a plurality of detonation waves that constructively interfere at multiple locations on the back surface of a cylindrical liner 514 to cut the liner and to simultaneously form and propel radially outward a plurality of SCJs.

Referring now to FIGS. 5A-5B and 6A-6C, an embodiment of a multi-point initiation system 600 uses a single detonator 602 positioned on or near a first board 604*a* to transfer a detonation wave to an initiation point 606*a* on the first board, a plurality of explosive jumpers 608*a*, 608*b*, 608*c*, . . . that connect the initiation point 606*a* from the first board 604*a* to an initiation point 606*b* on the second board 604*b* and so forth to an initiation point on the last board. Each board includes an explosive delay track 610*a*, 610*b*, 610*c*, . . . corresponding to a time delay that connects the initiation point 606*a*, 606*b*, 606*c* to the detonation point 612*a*, 612*b*, 612*c*. Time delay gets progressively shorter from one board to the next to offset a time delay of the detonation wave propagating from the first board to the last board such that all the detonation points 612*a*, 612*b*, 612*c* are detonated simultaneously producing detonation waves that travel through equal length explosive tracks 614 to booster charges 616, which in turn detonate an annular cylindrical column of explosive 618 to produce a plurality of detonation waves that constructively interfere at multiple locations on the back surface of a cylindrical liner 620 to cut the liner and to simultaneously form and propel radially outward a plurality of SCJs.

Referring now to FIGS. 7A-7H, a time-series of plots illustrating a detonation sequence to simultaneously form and propel multiple SCJs radially from the warhead with minimal to no axial velocity component. A warhead 700 includes a multi-point initiation system 701 that initiates boosters 702 at an inner surface of an annular cylindrical column of explosive 704 with a recessed liner 706 wrapped around an outer surface of explosive 704. The boosters 702 are aligned to the center of the individual recesses 708.

Upon simultaneous multi-point initiation of boosters 702, detonation waves 710 move through explosive 704. The detonation waves 710 interfere as they propagate through explosive 704. The boosters 702 are positioned at a stand-off distance from the liner such that that the waves constructively interfere to form elevated pressures 712 at the edges of the recesses. The elevated pressures are suitably between 110% and 200% of a detonation pressure at the front of the detonation waves at the center of the recesses. The stand-off distance is within a distance range wherein short of that range the waves do not sufficiently constructively interfere to form sufficiently elevated pressures and beyond that range interference would form a plane wave. For example, $0.1<=T1/D1<=0.5$ where T1 is the thickness of the explosive and D1 is the warhead diameter. The elevated pressures 712 cut the liner and cause the individual recesses 708 to collapse to form SCJs 714 that are propelled radially outward with minimal or no axial velocity component. For example, $0.5<=T1/D2<=1.5$ where D2 is the recess diameter.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. A warhead, comprising:

an annular cylindrical column of explosive;

a cylindrical liner on an outer surface of the annular cylindrical column of explosive, said cylindrical liner having a plurality of recesses;

a plurality of booster charges spaced apart on an inner surface of the annular cylindrical column of explosive and aligned to centers of the plurality of recesses; and an initiation system configured for multi-point initiation of the plurality of booster charges to detonate the annular cylindrical column of explosive to produce a plurality of detonation waves that constructively interfere at multiple locations on an inner surface of the liner at edges of the recesses to produce a pressure at the edges of the recesses that is at least 110% of a detonation pressure at a front of the detonation waves between the edges of the recesses to cut the liner and to form the recesses into a plurality of shaped charge jets (SCJs) that are propelled radially outward.

2. The warhead of claim 1, wherein the warhead has a diameter D1 and the column of explosive has a thickness T1, wherein $0.1<=T1/D1<=0.5$.

3. The warhead of claim 1, wherein pairs of directly adjacent detonation waves constructively interfere at mid-points between booster pairs to produce the pressure at the multiple locations in a non-planar wave within a distance range from the plurality of booster charges, wherein the liner is positioned within that distance range, wherein beyond that range interference of the plurality of detonation waves would form a plane wave.

4. The warhead of claim 1, wherein the pressure at the multiple locations is up to 200% of the detonation pressure.

5. The warhead of claim 1, wherein each recess is thinner in the center and thicker towards the edges.

6. The warhead of claim 1, wherein SCJ has a tip velocity of 4-10 km/s and a penetration depth of 7-10× the recess diameter.

7. The warhead of claim 1, wherein the column of explosive has a thickness T1 and a recess diameter D2 across the axis, wherein $0.5<=T1/D2<=1.5$.

8. The warhead of claim 7, wherein the warhead has a diameter D1, wherein $0.1<=T1/D1<=0.5$.

9. The warhead of claim 1, wherein each recess has an apex angle of 120-170°.

10. The warhead of claim 1, wherein each recess is a deep drawn conical structure having an apex angle of 40-120°.

11. The warhead of claim 1, wherein the booster charges are arranged in a pattern having X planes spaced along an axis of the column of explosive, each plane including Y booster charges spaced around the inner surface of the annular cylindrical column of explosive; wherein the initiation system comprises:

X boards positioned inside the annular cylindrical column of explosive and spaced along the axis of the column of explosive in alignment with respectively planes of booster charges, each board including a detonation point that is connected via Y equal length explosive tracks to one of the Y booster charges;

wherein each of said detonation points are detonated at the same time to produce detonation waves that travel through the explosive tracks to simultaneously initiate all of the booster charges.

12. The warhead of claim 11, wherein each board is provided with a detonator at the detonation point, each detonator is responsive to a separate electrical stimulus to initiate the detonator to produce the detonation waves that travel through the explosive tracks on the board.

13. The warhead of claim 11, further comprising a single detonator positioned on or near a first board to transfer a detonation wave to an initiation point on the first board, a plurality of explosive jumpers that connect the initiation point from the first board to an initiation point on the second board and so forth to an initiation point on the last board, wherein each board includes an explosive delay track corresponding to a time delay that connects the initiation point to the detonation point, wherein the time delay gets progressively shorter from one board to the next to offset a time delay of the detonation wave propagating from the first board to the last board such that all the detonation points are detonated simultaneously.

14. The warhead of claim 1, wherein the booster charges are arranged in a pattern having X planes spaced along an axis of the column of explosive, each plane including Y booster charges spaced around the inner surface of the annular cylindrical column of explosive; wherein the initiation system comprises:

X boards positioned inside the annular cylindrical column of explosive and spaced along the axis of the column of explosive in alignment with respective planes of booster charges, each board including a detonation point that is connected via Y explosive tracks to one of the Y booster charges;

wherein each of said detonation points are detonated to produce detonation waves that travel through the explosive tracks to initiate all of the booster charges to form a pattern of the multiple SCJs.

15. A warhead having a diameter D1, said warhead comprising:

an annular cylindrical column of explosive having a thickness T1;

a cylindrical liner on an outer surface of the annular cylindrical column of explosive, said cylindrical liner having a plurality of recesses each having a diameter D2;

a plurality of booster charges spaced apart on an inner surface of the annular cylindrical column of explosive and aligned to centers of the plurality of recesses; and an initiation system configured for multi-point initiation of the plurality of booster charges to detonate the annular cylindrical column of explosive to produce a plurality of detonation waves that constructively interfere at multiple locations on an inner surface of the liner at the edges of the recesses to produce a pressure at the edges of the recesses that is at least 110% of a detonation pressure at a front of the detonation waves between the edges of the recesses to cut the liner and to form the recesses into a plurality of shaped charge jets (SCJs) that are propelled radially outward;

wherein $0.1 <= T1/D1 <= 0.5$ and wherein $0.5 <= T1/D2 <= 1.5$.

16. A warhead, comprising:

an annular cylindrical column of explosive;

a cylindrical liner on an outer surface of the column of explosive, said cylindrical liner having a plurality of recesses;

a plurality of booster charges arranged in a pattern having X planes spaced along an axis of the column of explosive, each plane including Y booster charges spaced around the inner surface of the annular cylindrical column of explosive and aligned to centers of the plurality of recesses; and an initiation system including X boards positioned inside the annular cylindrical column of explosive and spaced along the axis of the column of explosive in alignment with respective planes of booster charges, each board including a detonation point that is connected via Y equal length explosive tracks to one of the Y booster charges;

wherein each of said detonation points are detonated at the same time to produce detonation waves that travel through the explosive tracks to simultaneously initiate all of the booster charges to detonate the column of explosive to produce a plurality of detonation waves that constructively interfere at multiple locations on a back surface of the liner at edges of the recesses to produce a pressure at the edges of the recesses that is at least 110% of a detonation pressure at a front of the detonation waves between the edges of the recesses to cut the liner and to form the recesses into a plurality of shaped charge jets (SCJs) that are propelled radially outward.

17. The warhead of claim 16, wherein each board is provided with a detonator at the detonation point, each detonator is responsive to a separate electrical stimulus to initiate the detonator to produce the detonation waves that travel through the explosive tracks on the board.

18. The warhead of claim 16, further comprising a single detonator positioned on or near a first board and responsive to a single electrical stimulus to transfer a detonation wave to an initiation point on the first board, a plurality of explosive jumpers that connect the initiation point from the first board to an initiation point on the second board and so forth to an initiation point on the last board, wherein each board includes an explosive delay track corresponding to a time delay that connects the initiation point to the detonation point, wherein the time delay gets progressively shorter from one board to the next to offset a time delay of the detonation wave propagating from the first board to the last board such that all the detonation points are detonated simultaneously.

* * * * *